United States Patent [19]

Justice

[11] Patent Number: 4,571,592

[45] Date of Patent: Feb. 18, 1986

[54] SKIN EFFECT ANTENNAS

[75] Inventor: Raymond Justice, San Diego, Calif.

[73] Assignee: Cubic Corporation, San Diego, Calif.

[21] Appl. No.: 471,771

[22] Filed: Mar. 3, 1983

[51] Int. Cl.[4] ..... H01Q 13/10

[52] U.S. Cl. ..... 343/767

[58] Field of Search ..... 343/705, 708, 788, 846, 343/895, 767, 908

[56] References Cited

U.S. PATENT DOCUMENTS

| | | | |
|---|---|---|---|
| 3,409,891 | 11/1968 | Lode | 343/788 |
| 3,686,674 | 8/1972 | Clasby et al. | 343/895 |
| 4,473,806 | 9/1984 | Johnston | 333/101 |

*Primary Examiner*—Eli Lieberman

*Attorney, Agent, or Firm*—Brown, Martin & Haller

[57] ABSTRACT

A microwave device in which resonance at a first microwave frequency is determined by the dimensions of a discontinuity defined by conductive material, such as slot antennas, cavity-backed antennas and transmission line stubs. In one aspect of the invention, the thickness of the conductive material in a bounded portion of the conductive material adjacent the discontinuity is equal to the skin depth of the conductive material at the first microwave frequency to thereby effectively redimension the discontinuity at a lower second microwave frequency to cause the device to also be resonant at the second frequency. In a separate aspect of the invention, the thickness of the conductive material in a bounded portion of the conductive material adjacent the discontinuity varies continuously from the skin depth of the conductive material at the first frequency at the discontinuity to the skin depth of the conductive material at a lower second microwave frequency at the boundary of said portion to thereby effectively redimension the discontinuity in a frequency band extending between the first and second frequencies to cause the device to be resonant over such frequency band.

3 Claims, 7 Drawing Figures

SKIN EFFECT ANTENNAS

BACKGROUND OF THE INVENTION

The present invention generally pertains to microwave devices, such as antennas and stubs and is particularly directed to improvements in microwave devices in which resonance at a given microwave frequency is determined by the dimensions of a discontinuity defined by conductive material.

One such device is a microwave slot antenna in which the resonant frequency in a given plane is determined by the length of a slot in a given dimension corresponding to the plane. The slot is defined by a conductive material discontinuity and has a length in the given dimension equal to one-half the wavelength corresponding to the given microwave frequency.

Another such device is a microwave cavity-backed antenna in which the resonant frequency is determined by the dimensions of a cavity disposed in back of a radiating element. A cavity-backed spiral antenna is an example of this type of device. The radiating element is backed by a conductive material structure, such as a cylinder, having boundaries dimensioned to define a resonant cavity at the given microwave frequency.

Still another such device is a microwave transmission line stub including complementary layers of a conductive material each having a branch dimensioned for impedance matching the transmission line at the given frequency, wherein the branches are connected to each other at their extreme ends.

SUMMARY OF THE INVENTION

The present invention utilizes skin effect to make microwave devices resonant at more than the one frequency determined by the dimensions of the discontinuity defined by the conductive material.

Skin effect is the tendency of current density in a conductive material at microwave frequencies to be concentrated near the surface of the conductive material, thereby effectively increasing the resistance of the conductive material at microwave frequencies. The depth in the conductive material at which current density is decreased to 36.8 percent of its surface value is referred to as the skin depth. The relationship between skin depth and frequency is defined by $$\text{Skin depth} = [2.6 \div \sqrt{f(\text{MHz})}\ ]\ \text{mils} \qquad \text{(Eq. 1)}$$

A conductive material having a thickness equal to its skin depth functions as a high dielectric constant material at frequencies below the microwave frequency that defines the skin depth.

In one aspect, the present invention is a microwave device in which resonance at a first microwave frequency is determined by the dimensions of a discontinuity defined by conductive material, characterized by the thickness of the conductive material in a bounded portion of the conductive material adjacent the discontinuity being equal to the skin depth of the conductive material at the first microwave frequency to thereby effectively redimension the discontinuity at a lower second microwave frequency to cause the device to also be resonant at the second frequency.

In another aspect, the present invention is a microwave device in which resonance at a first microwave frequency is determined by the dimensions of a discontinuity defined by conductive material, characterized by the thickness of the conductive material in a bounded portion of the conductive material adjacent the discontinuity being variable continuously from the skin depth of the conductive material at the first frequency at the discontinuity to the skin depth of the conductive material at a lower second microwave frequency at the boundary of said portion to thereby effectively redimension the discontinuity in a frequency band extending between the first and second frequencies to cause the device to be resonant over said frequency band.

The present invention is particularly applicable to slot antennas, cavity-backed antennas and transmission line stubs; and is further applicable to other microwave devices utilizing skin effect to make the device resonant at more than one frequency.

Additional features of the present invention are described in relation to the description of the preferred embodiments.

Figure 1:
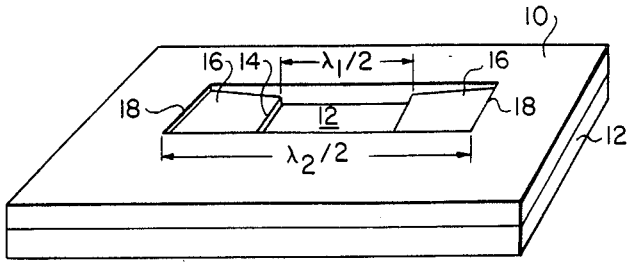
FIG. 1 illustrates one preferred embodiment of a microwave slot antenna.

The figures of the Drawing are not to scale. The dimensions of various illustrated elements are exaggerated to more clearly show the features of such elements.

DESCRIPTION OF THE PREFERRED EMBODIMENTS

Figure 5:
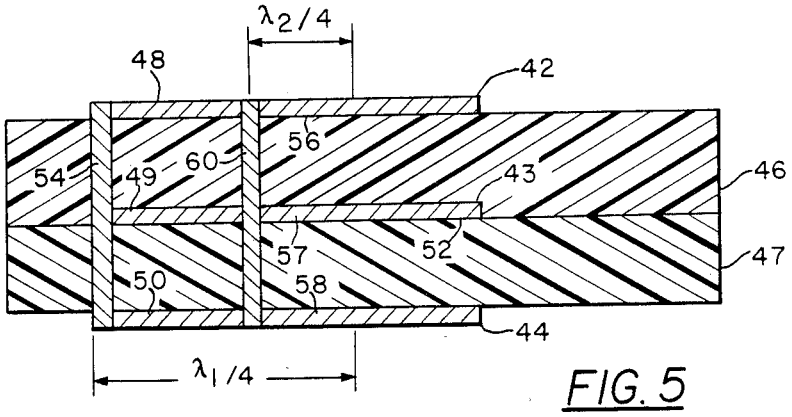
FIG. 5 is a sectional view of the transmission line stub of FIG. 4, taken along line 5—5.
Figure 6:
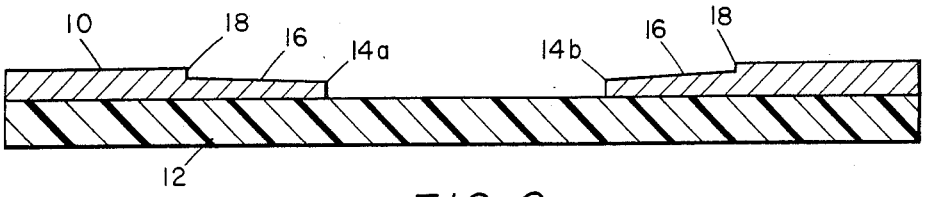
FIG. 6 is an enlarged longitudinal sectional view taken through the cavity of FIG. 1.

Referring to FIGS. 1, 5, and 6 one preferred embodiment of a microwave slot antenna according to the present invention includes a layer of conductive material 10, such as copper, which may be on a substrate of high dielectric constant material 12, or which may be in free space. The layer of conductive material 10 defines a slot 14 having first and second slot boundaries **14*a*, 14*b* at a length in one given dimension equal to one-half the wavelength corresponding to a first microwave frequency ($\lambda_1/2$). The conductive material layer 10 includes interior portions 16 symmetrical to the slot 14 and defined by median boundaries 18 separated across the slot 14 in the given dimension by a distance equal to one-half the wavelength corresponding to a second microwave frequency ($\lambda_2/2$) that is lower than the first frequency. The interior portions 16 have a thickness that varies continuously from the skin depth of the conductive material at the first microwave frequency at the slot 14 to the skin depth of the conductive material at the second microwave frequency at the median boundaries 18. The layer of conductive material 10 extending beyond the interior portions 16 is thicker than the skin depth of the conductive material at the second microwave frequency. At the second frequency the entirety of the interior portions 16** functions as a high dielectric constant material. Accordingly the slot is effectively redimensioned continuously as a function of frequency as the frequency varies between the first and second frequencies. At the second frequency the effective slot length is one-half the wavelength corresponding to the second microwave frequency ($\lambda_2/2$). As a result the antenna is resonant over a frequency band extending between the first and second frequencies.

Figure 7:
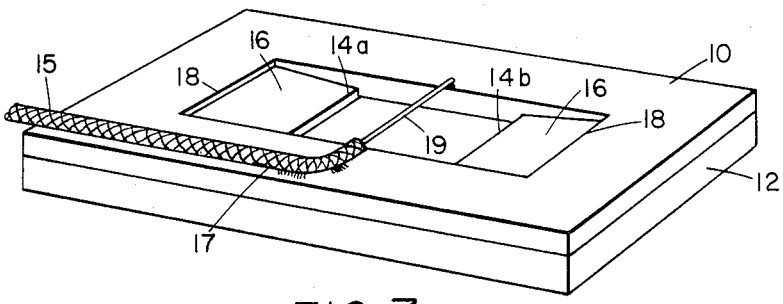
FIG. 7 is a perspective view of the cavity of FIG. 1 showing placement of a coaxial center-feed conductor.

As illustrated in FIG. 7, the microwave slot antenna may be fed with a coaxial conductor, shown generally as 15, having a shielded outer conductor 17 that is soldered or otherwise conductively connected to the layer of conductive material 10, and having center conductor 19 that spans the center of slot 14 and is soldered or otherwise conductively connected to the layer of conductive material 10 on the other side of the slot 14.

Figure 2:
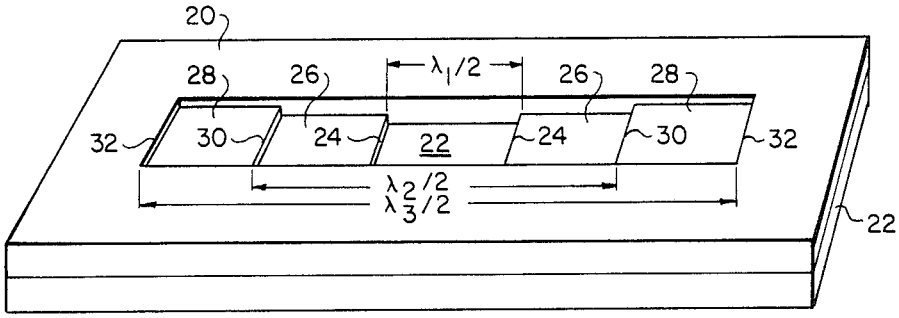
FIG. 2 illustrates an alternative preferred embodiment of a microwave slot antenna.

Referring to FIG. 2, another preferred embodiment of a microwave slot antenna according to the present invention includes a layer of conductive material 20, such as copper, which may be on a substrate of high dielectric constant material 22, or which may be in free space. The layer of conductive material 20 defines a slot 24 having a length in one given dimension equal to one-half the wavelength corresponding to a first microwave frequency ($\lambda_1/2$).

The conductive material layer 20 includes first interior portions 26 and second interior portions 28. The first interior portions 26 are defined by first median boundaries 30 separated across the slot 14 in the given dimension by a distance equal to one-half the wavelength corresponding to a second microwave frequency ($\lambda_2/2$) that is lower than the first frequency.

The second interior portions 28 are adjacent the first interior portions 26 and are defined by second median boundaries 32 separated across the first interior portions 26 and the slot 24 in the given dimension by a distance equal to one-half the wavelength corresponding to a third still lower microwave frequency ($\lambda_3/2$).

The first interior portions 26 have a thickness equal to the skin depth of the conductive material at the first microwave frequency. The second interior portions 28 have a thickness equal to the skin depth of the conductive material at the second microwave frequency. The conductive material 20 extending beyond the interior portions 26, 28 is thicker than the interior portions 26, 28. At the second frequency, the first interior portions 26 function as a high dielectric constant material to thereby effectively redimension the slot 24 to have a length $\lambda_2/2$ between the first median boundaries 30. At the third frequency the first and second interior portions 26, 28 function as a high dielectric constant material to effectively redimension the slot 24 to have a length $\lambda_3/2$ between the second median boundaries 32. As a result the antenna is resonant at the first, second and third frequencies.

Figure 3:
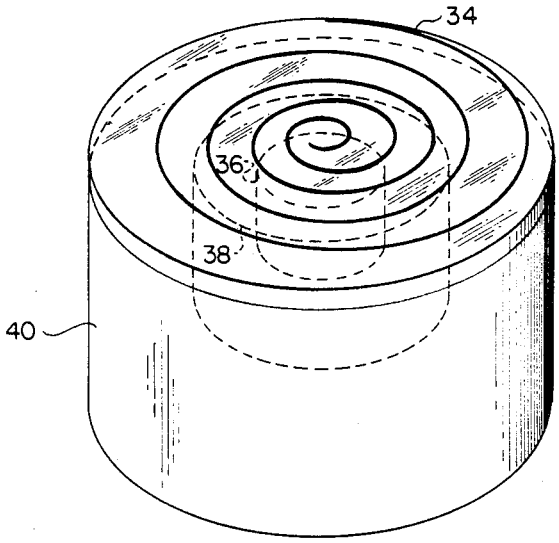
FIG. 3 illustrates a preferred embodiment of a cavity-backed microwave antenna.

Referring to FIG. 3, a preferred embodiment of a cavity-backed antenna according to the present invention includes a radiating element 34, such as a spiral of conductive material, and three concentric conductive material cylinders 36, 38, 40 disposed in back of the radiating element 34.

The spiral radiating element is spaced from the respective cylinders 36, 38, 40 by supporting structure (not shown) in accordance with the desired optical and resonance characteristics of the antenna. Each of the cylinders 36, 38, 40 is closed at the bottom and open at the top adjacent the radiating element 34 to define a cavity in back of the element 34. The boundaries of each cylinder 36, 38, 40 are defined by the side and bottom walls thereof.

The first (interior) cylinder 36 is disposed in back of the radiating element 34 and has its boundaries dimensioned to define a resonant cavity at a first microwave frequency.

The second (middle) cylinder 38 surrounds the first cylinder 36 in back of the radiating element 34 and has its boundaries dimensioned to define a resonant cavity at a second microwave frequency that is lower than the first frequency.

The third (outer) cylinder 40 surrounds the second cylinder 38 in back of the radiating element 34 and has its boundaries dimensioned to define a resonant cavity at a still lower third microwave frequency.

The walls of the (interior) cylinder 36 have a thickness equal to the skin depth of the conductive material at the first microwave frequency; and the walls of the second (middle) cylinder 38 have a thickness equal to the skin depth of the conductive material at the second microwave frequency, and thereby are thicker than the walls of the first cylinder 36. The walls of the third (outer) cylinder 40 are thicker than the walls of the second cylinder 38.

At the second frequency, the first (interior) cylinder 36 functions as a high dielectric constant material to thereby effectively redimension the cavity of the antenna to cause the antenna to be resonant at the second frequency defined by the boundaries of the second (middle) cylinder 38. At the third frequency the first and second cylinders 36, 38 both function as a high dielectric constant material to effectively redimension the cavity of the antenna to cause the antenna to be resonant at the third frequency defined by the boundaries of the third outer cylinder 40. As a result the antenna is resonant at the first, second and third frequencies.

Figure 4:
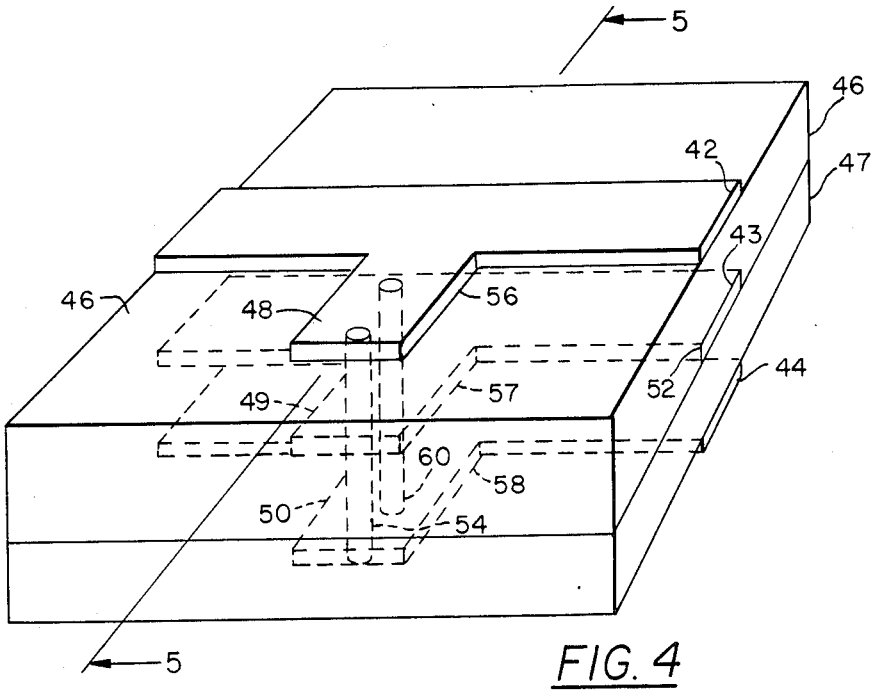
FIG. 4 illustrates one preferred embodiment of a microwave transmission line stub.

Referring to FIGS. 4 and 5, one preferred embodiment of a quarter-wave transmission line stub includes three complementary layers of conductive material 42, 43, 44 on and between two high dielectric constant substrates 46, 47. One conductive material layer 43 is sandwiched between the two substrates 46, 47. The other two conductive material layers 42, 44 are on the respective broad exposed surfaces of the substrates 46, 47. Each layer of conductive material 42, 43, 44 has a branch 48, 49, 50 dimensioned for impedance matching a transmission line 52 at a first microwave frequency. Each branch 48, 49, 50 has a length equal to one-quarter the wavelength corresponding to the first microwave frequency ($\lambda_1/4$). The branches 48, 49, 50 are connected to each other at their extreme ends by a conductive material strip 54.

It is desired to also impedance match the transmission line 52 at a second microwave frequency that is higher than the first frequency. Accordingly the extreme portions 56, 57, 58 of the branches 48, 49, 50, each of which portions being of a length that is proportional to the difference between the respective wavelengths ($\lambda_1/4-\lambda_2/4$), are connected to each other at their respective interior boundaries by a conductive material strip 60 having a thickness equal to the skin depth of the conductive material at the higher second frequency. All of the remaining conductive material is thicker than its skin depth at the lower first frequency. At the higher second frequency the interconnection provided by the material strip 60 causes the branches 48, 49, 50 to be of a length $\lambda_2/4$ so as to impedance match the transmission line at the second frequency. At the lower first frequency the material strip 60 takes on the property of a dielectric material and effectively redimensions the branches 48, 49, 50 to be of a length $\lambda_1/4$ so as to impedance match the transmission line at the first frequency.

I claim:

1. A microwave slot antenna comprising: a layer of conductive material having a slotted opening therethrough; said slotted opening having a length equal to one-half the wavelength of a first microwave frequency;

the conductive material on opposite end-sides of said slotted opening having a thickness equal to the skin depth of the conductive material at said first microwave frequency;

the thickness of said conductive material increasing outwardly from said slotted opening such that at a second microwave frequency separation distance symmetrical to said slotted opening of one-half the wavelength of said second microwave frequency, said thickness is equal to the skin depth of the conductive material at said second microwave frequency; so that said antenna resonates at said first and second frequencies.

2. The microwave slot antenna of claim 1 wherein the thickness of said conductive material increases progressively symmetrically outwardly from said slotted opening to said second microwave frequency separation distance such that said thickness at a separation distance of one-half a frequency intermediate said first and second frequencies is equal to the skin depth of the conductive material at the intermediate frequency so that said antenna also resonates at all intermediate frequencies.

3. The microwave slot antenna of claim 1 wherein the outwardly increasing thickness increases abruptly at said second frequency separation distance to said second frequency skin depth such that the antenna resonates at said first and second frequencies and not at any intermediate frequencies.

* * * * *